US005930977A

United States Patent [19]

Hsu

[11] Patent Number: 5,930,977

[45] Date of Patent: Aug. 3, 1999

[54] AUTOMATIC FILM-LID COHERING MACHINE

[76] Inventor: Sui-Hsin Hsu, 3F, No. 126, Sec. 2, Chung Yang Rd., Tu Cheng, Taipei Hsien, Taiwan

[21] Appl. No.: 09/126,397

[22] Filed: Jul. 30, 1998

[51] Int. Cl.[6] ..... B65B 51/10

[52] U.S. Cl. ..... 53/329.5; 53/329.3; 53/369

[58] Field of Search ..... 53/329.5, 329.3, 53/329.2, 478, 311, 312, 369

[56] References Cited

U.S. PATENT DOCUMENTS 4,625,498 12/1986 Parsons ..... 53/329.5
5,182,896 2/1993 Maccherone ..... 53/329.5
5,272,854 12/1993 Ye et al. ..... 53/329.5

*Primary Examiner*—John Sipos
*Assistant Examiner*—Steven Jensen
*Attorney, Agent, or Firm*—Rosenberg, Klein & Bilker

[57] ABSTRACT

An automatic film-lid cohering machine, which consists of a film transmission structure, an anti-slide device, a film-lid cohering transmission structure, a film-lid cohered object replacement device, and a holder. This invention is essentially to simplify the anti-slide device and the holder, whereby the manufacturing cost may be lowered and installation of the film is made easier. An automatic propping device is included in the subject machine to make it faster to remove an object which has been cohered by film-lid. Gears, instead of chains, are used to operate the primary film roller to prevent slacked transmission.

3 Claims, 11 Drawing Sheets

AUTOMATIC FILM-LID COHERING MACHINE

FIELD OF THE INVENTION

The present invention relates to an automatic lid sealer, and more particularly to an automatic film-lid cohering machine with low manufacturing cost and easy operations.

DESCRIPTION OF PRIOR ART

An automatic film-lid cohering machine is widely known as an automatic device for continuous film-lid cohering process. The structure of a traditional lid sealer is complicated and its manufacturing cost is high. It is also inconvenient, time-consuming, and dangerous to install a film in a traditional lid sealer, because the film has to be taken out manually.

The primary objective of this invention is to provide an automatic film-lid cohering machine, which consists of a film transmission structure, an anti-slide device, a film-lid cohering transmission structure, a film-lid cohered object replacement device, and a holder. This invention is to simplify the anti-slide device and the holder so as to make the manufacturing and assembly process easier, whereby the manufacturing cost will be lowered and the strength and the stability of the holder will be improved. As it is not necessary to insert the film in the anti-slide device, the installation of the film becomes relatively easier. This invention also includes an automatic propping device, which is designed to cause a lift to automatically prop a film-lid cohered object on the cover, so that the object may be easily removed after the film-lid cohering process is completed. Since the lift in the automatic propping device is designed to work with two lifting grooves in the holder, it may move forward and backward as well as up and down steadily. Besides, gears in lieu of chains are used to operate the film roller to prevent slacked transmission.

For better understanding the features and technologies concerning this invention, the following description and drawings are provided for reference. However, the figures attached hereto are for reference and description only, and they should in no way be used to impose any restrictions on this invention. The drawings for the preferred embodiment are below.

DETAILED DESCRIPTION OF PREFERRED EMBODIMENT

Figure 14:
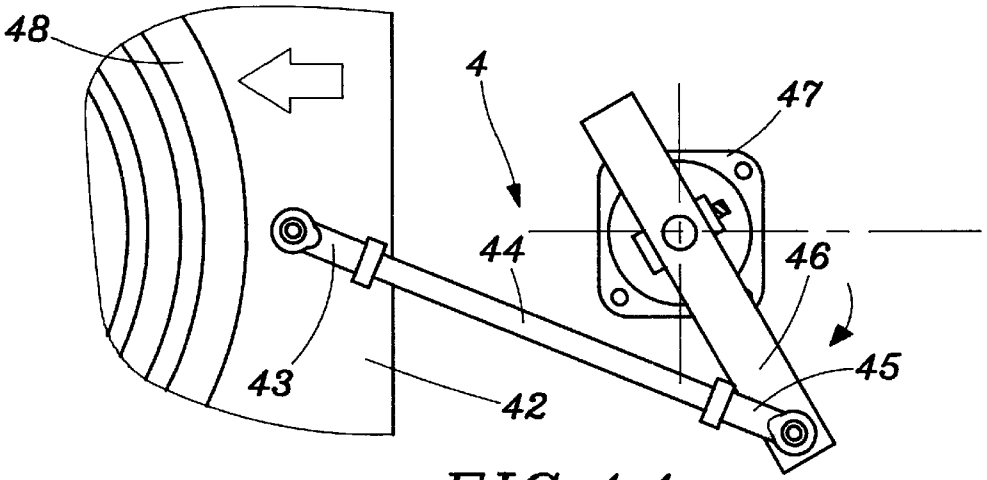
FIG. 14 is a scheme plan of the film-lid cohered replacement device in this invention.

Film transmission structure 1 is designed to cause the film to work in conjunction with a film-lid cohering process. Such a structure is to establish two axles 11 on the holder 5. A primary film roller may be placed on one of the axles 11, and a film roller 17 may be placed in the other axle 11. There is a first gear 12 and a clamp 13 on the axle 11 of the primary film roller 16. The clamp 13 is used to fix the primary film roller 16. The first gear 12 matches the second gear 14 affixed to the axle of the feeding motor 15. (FIG. 14). When the feeding motor 15 on the film transmission structure 12 is driven, the second gear 14 will be transmitted to drive the first gear 12. The clamp 13 will in turn drive the primary film roller 16 to roll up the film and to roll down the film on the film roller 17.

Figure 1:
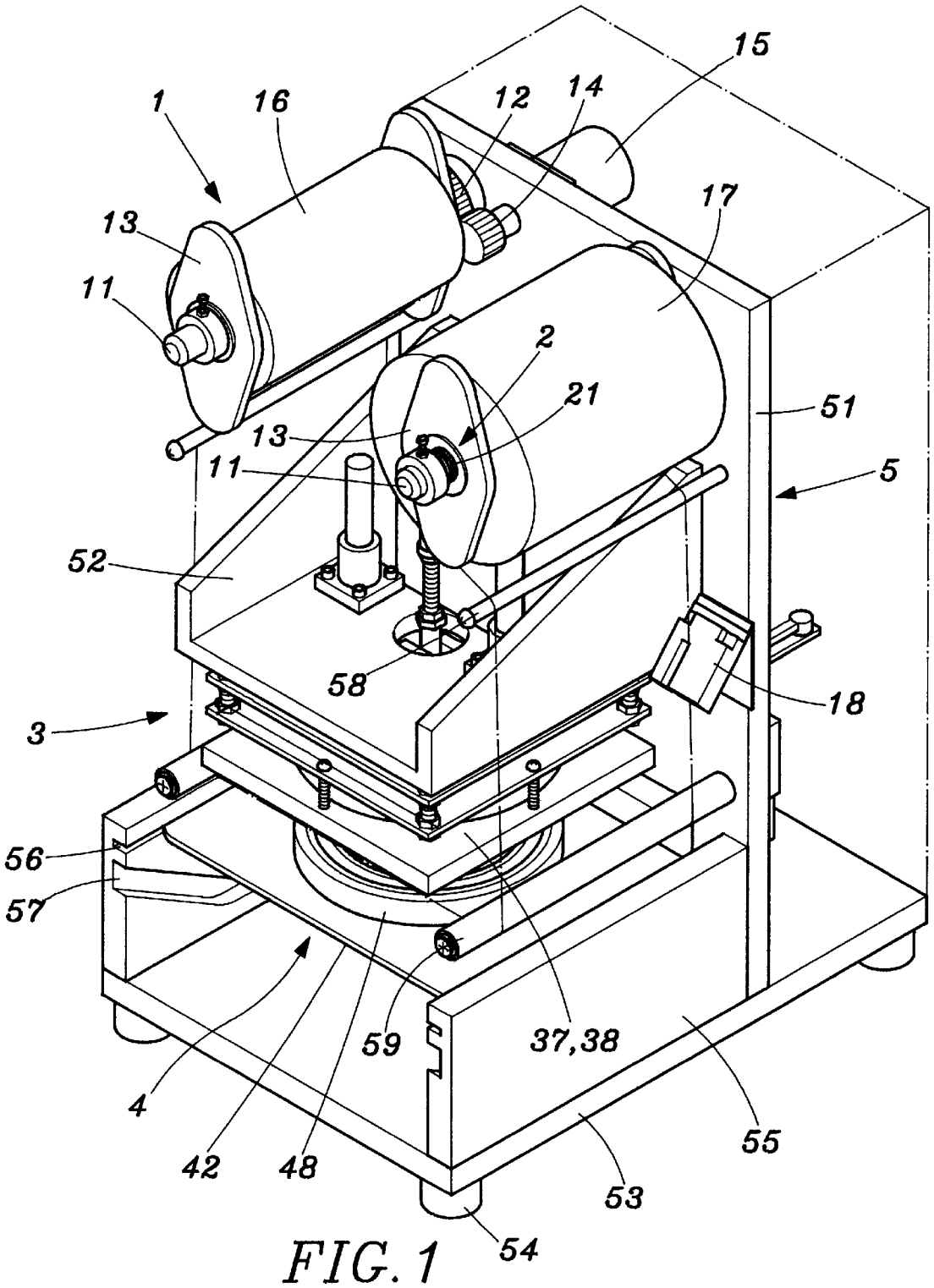
FIG. 1 is a pictorial drawing of this invention.
Figure 2:
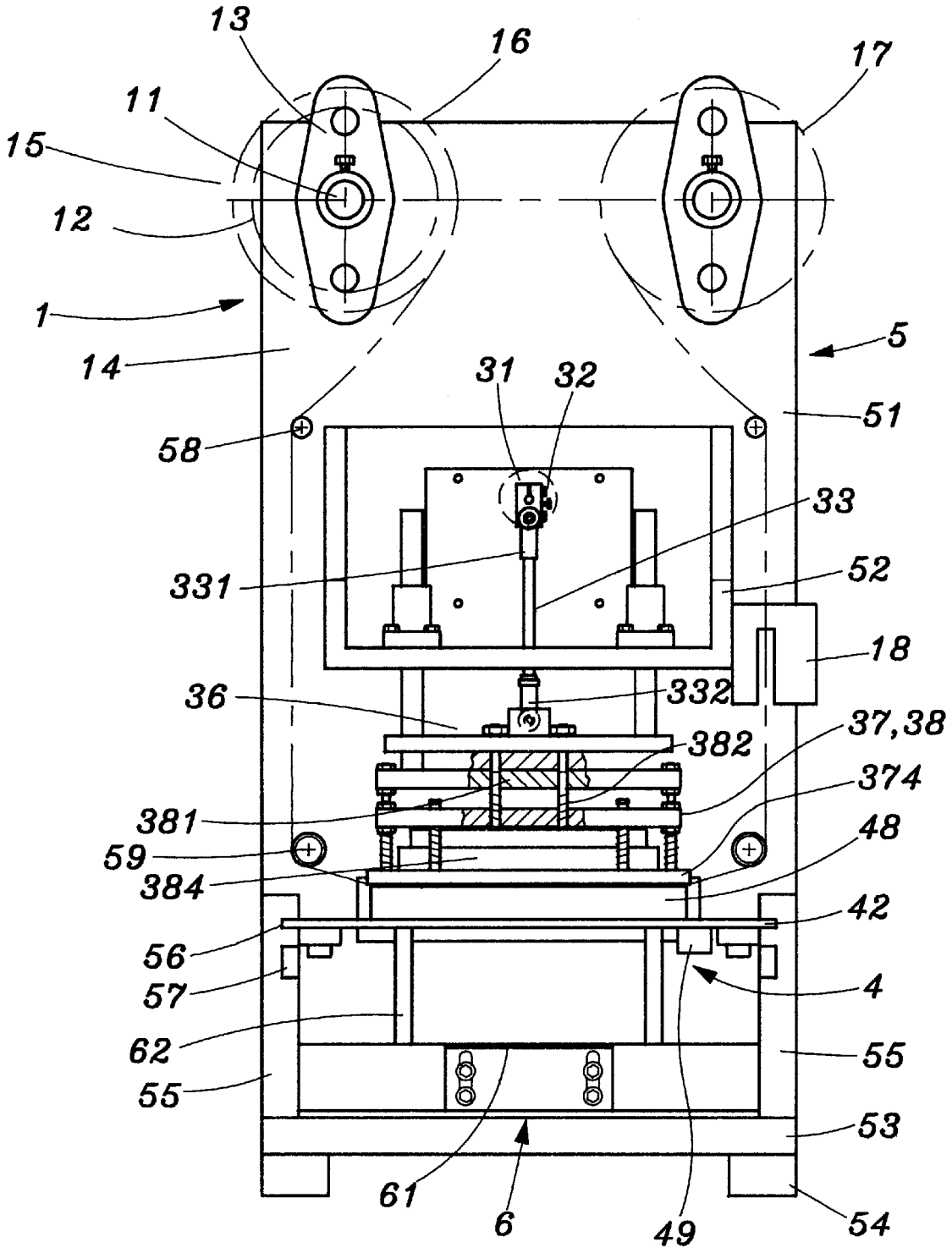
FIG. 2 is a front view of this invention.
Figure 3:
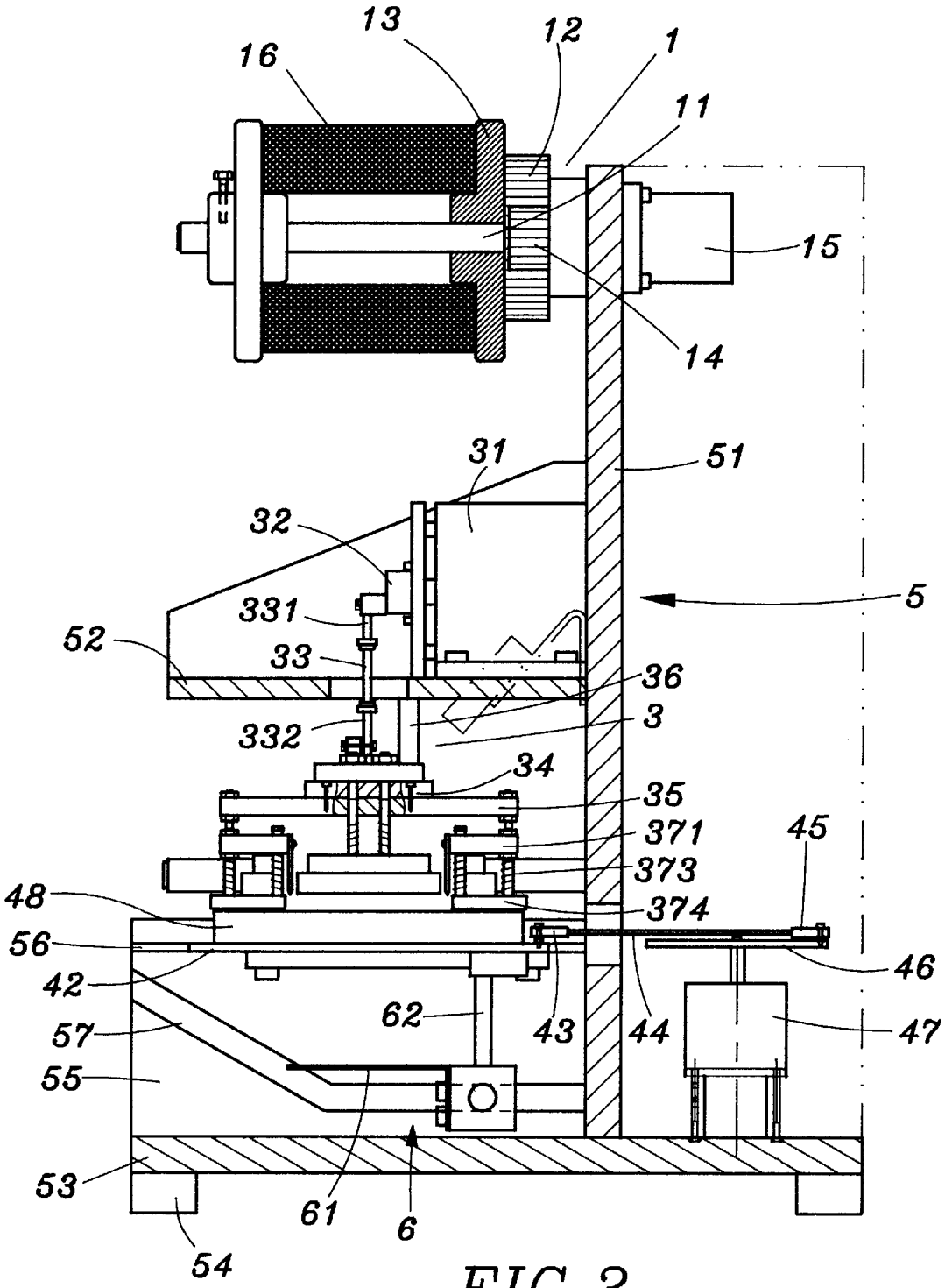
FIG. 3 is a side view of this invention.
Figure 4:
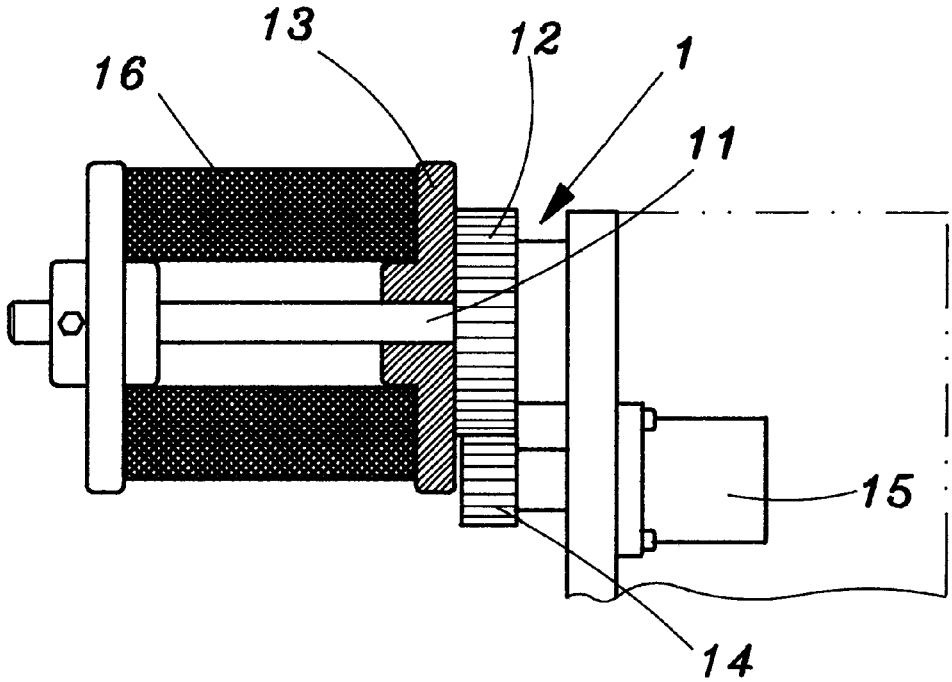
FIG. 4 is a side view of primary film roller of this invention
Figure 5:
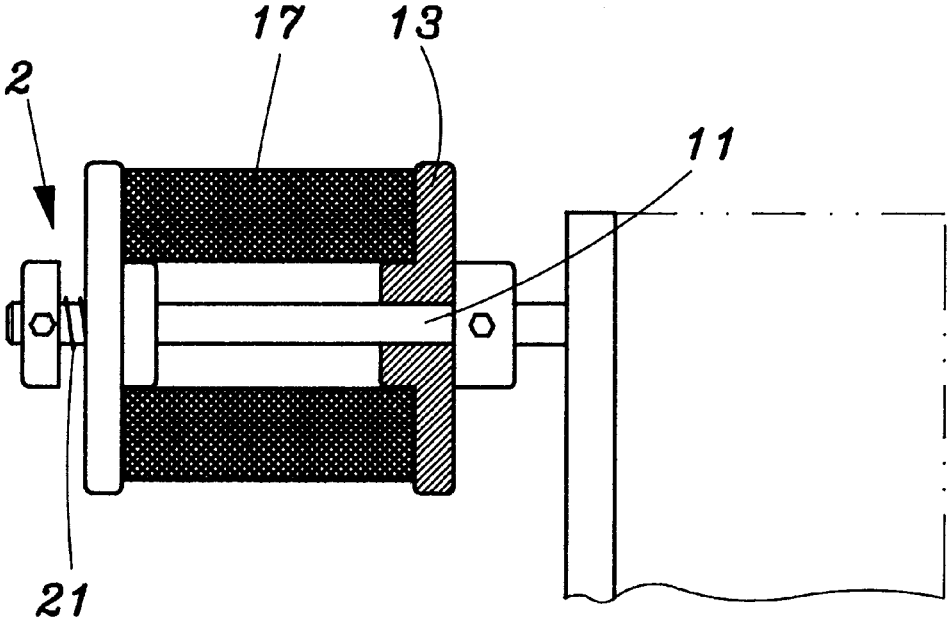
FIG. 5 is a side view of the film roller in this invention.

The anti-slide device 2 (FIG. 5) is established on the axle 11 of the film roller 17. The device is designed to set up a spring 21 on one end of the axle 11. The spring 21 may push the clamp 13 on the end of axle 11. When the film transmission structure is in motion, the primary film roller will pull the film. While the primary film roller is stopped, inertia will keep the film roller 17 running. At this point, the spring 21 will impose such proper resistance on the clamp 13 to prevent the film roller 17 from rolling down the film.

Figure 6:
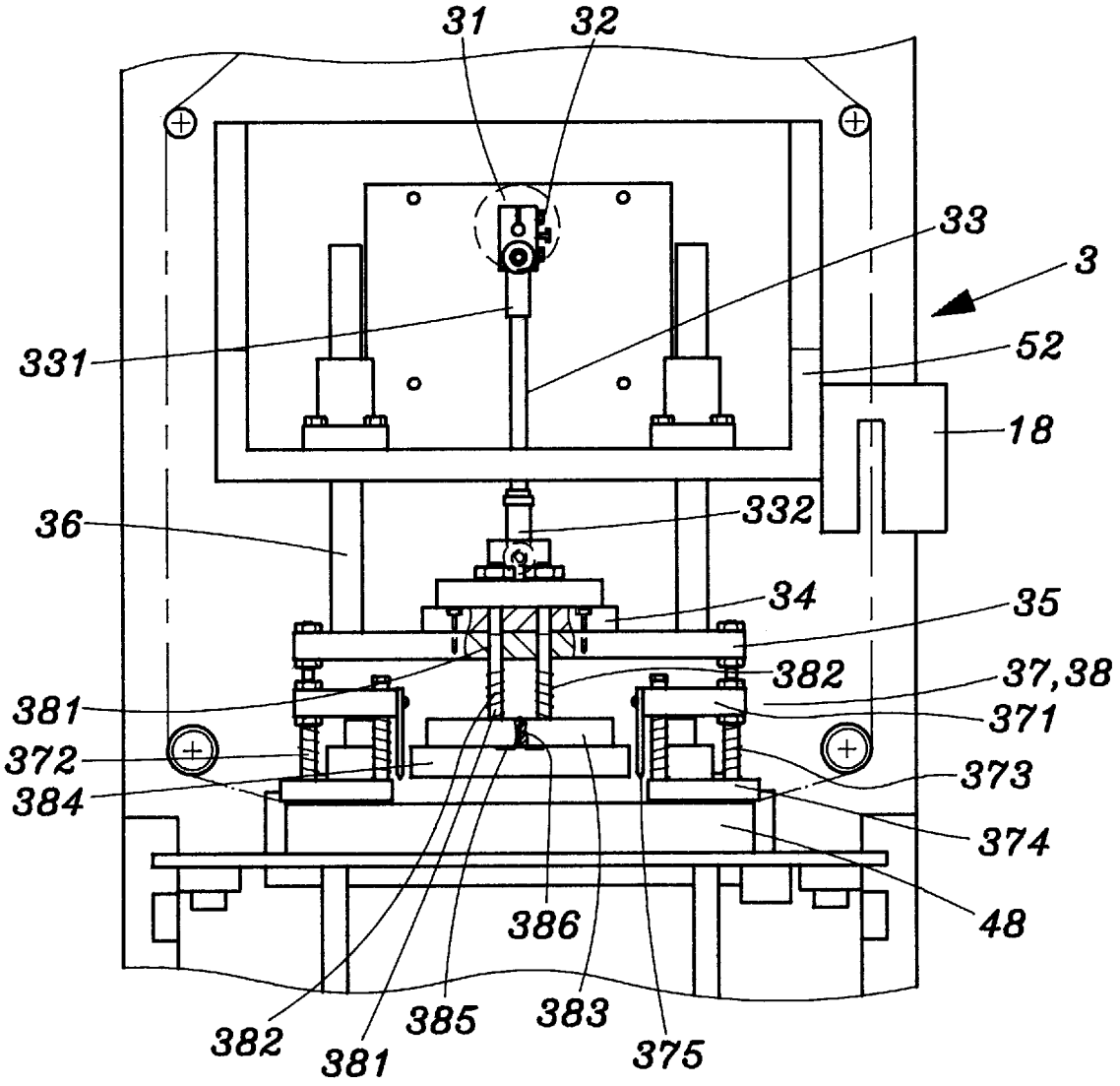
FIG. 6 is a front view of film-lid cohering transmission structure in this invention.
Figure 7:
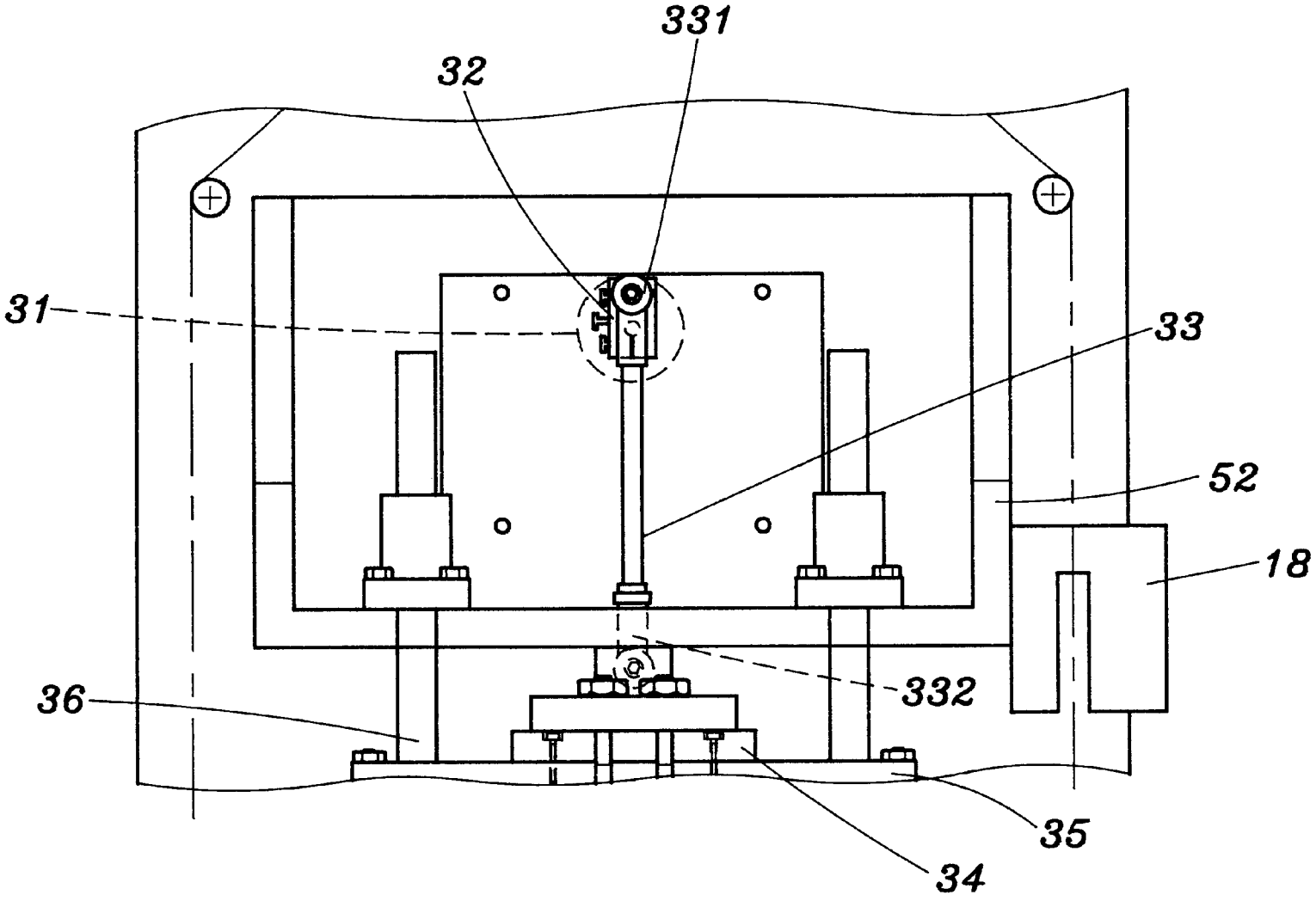
FIG. 7 is a scheme plan of film-lid cohering transmission structure in this invention.
Figure 8:
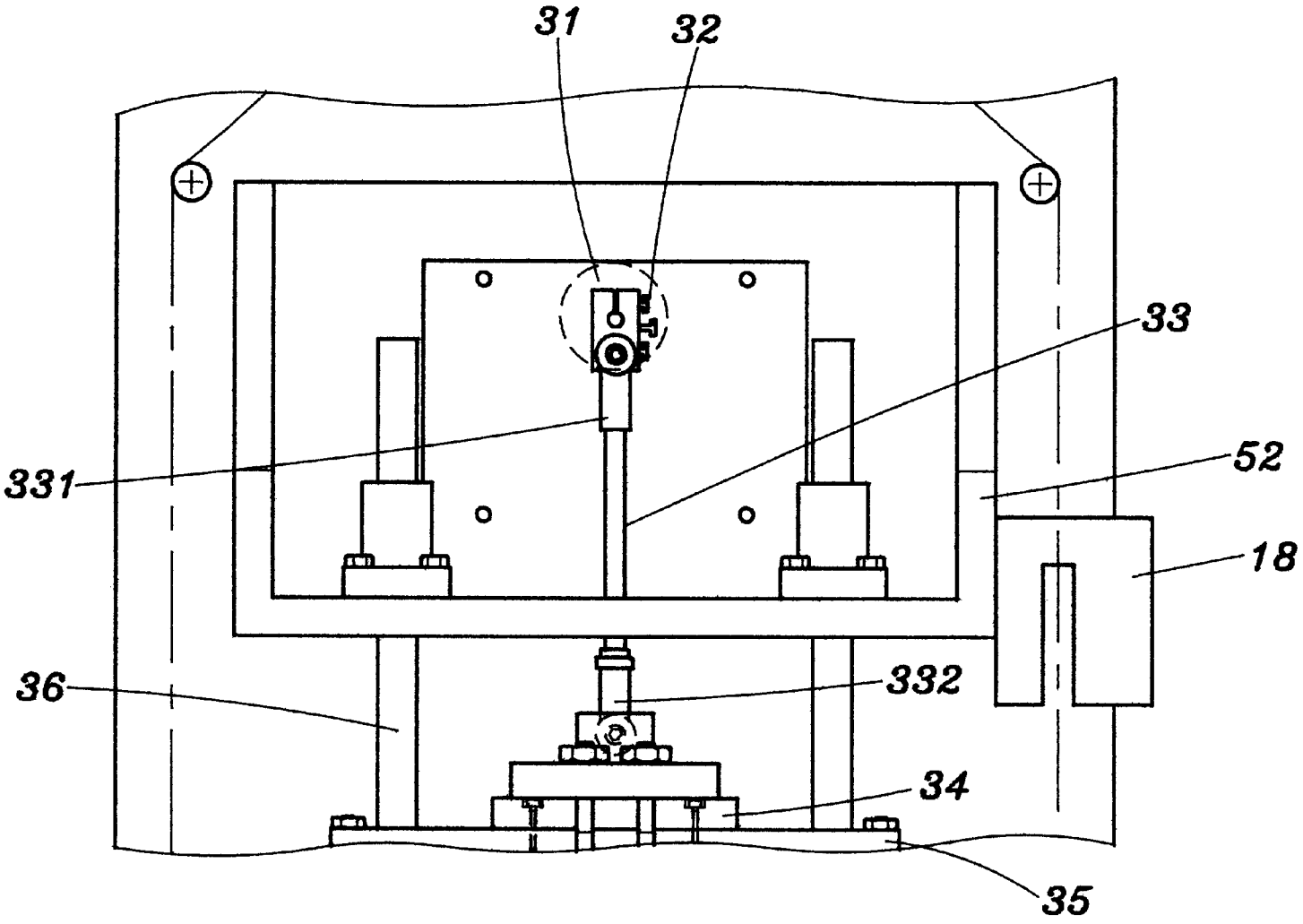
FIG. 8 is a scheme plan of film-lid cohering transmission structure in this invention.

The lid sealing device transmission structure 3 (FIG. 6) is designed to establish a motor 31 on the partition plate 52 of the holder 5. The axle of the motor 31 is secured to connect with a crank 32. There is a connector 331 on one end of said crank 32 to link to the coupling bar 33. The connector 332 is used to link the other end of the coupling bar 33 to the top mold adjuster 34 and the top connecting mold 35 under the partition plate 52. On the top connecting mold 35 are two guide posts 36 penetrating and sliding through partition plate 52, and said guide posts 36 may lead the top mold adjuster 34 and the top connecting mold 35 to stabilize the lifting. The top connecting mold 35 is also fastened to the cutting devices 37 and 38. Under the top connecting mold 35 are blade holders 371 on both sides of the cutting devices 37 and 38. An external connecting bar 372 is on the blade holder 371 to connect with the external press sheet 374. There is an external press spring 373 on the external connecting bar 372 to absorb the downward vibration, and there are blades 375 on the inner face of the blade holders to cut the film. Two connecting bars 381 are fixed to the top connecting mold 35 and joint plate 383. The internal connecting bars contain internal press springs 382 to absorb the downward vibration generated by the internal pressing sheet. There is a heating plate 385 between the joint plate 383 and internal press plate 384. The cable 386 of the heating plate 385 penetrates said joint plate 383. When the motor 31 of the lid sealing device transmission structure 3 is turned on, the crank 32 will revolve by using the axle of the motor 31 as a center. The other end of the crank 32 will cause the top connecting mold 35 and the cutting devices 37 and 38 to move up and down through the connector 331, coupling bar 33, and the connectors 332. (FIG. 7 and FIG. 8). When the film passes under the cutting devices 37 and 38 and when the object for lid sealing device is placed on the cover 48, the motor 31 will be driven to cause the top connecting mold 35 to press down, whereby the external press sheet 374 and internal press plate will press on the film momentarily, and then the blades 375 will cut the film to the desired shape. The heating plate 385 on the internal press plate 384 will cause the film cohered to the object for lid sealing device. Upon completion of cohesion process, the top connecting mold 35 and cutting devices 37 and 38 will elevate altogether.

The film-lid cohered object replacement device 4 (FIG. 9 and FIG. 10) contains an operation plate 42, and glide grooves 56 being on each of the inner faces of the two groove plates 55 of the holder 5. The lifting glides 57 are ascending to the front, and both sides of the operation platform 42 may work in said glide grooves 56 and move forward and backward freely. On the bottom of the operation platform 42 is a connector 43, to which a connecting bar 44 is secured, and said connecting bar 44 is further linked to a crank 46 by a connector 45. The middle of the crank 46 is fastened to the axle of the film-lid cohesion replacement motor 47. When said film-lid cohesion replacement motor 47 is driven, the crank 46 will revolve by using the axle of the motor 47 as the center. One end of the crank 46 will pull the operation platform 42 backward or forward through the connector 45, connecting bar 44, and the connector 43. (FIG. 11 through FIG. 14). When the operation platform 42 is pulled back to a fixed position, and when said operation platform 42 is pulled to a point under cutting devices 37 and 38, the film-lid cohesion transmission structure will place the film onto the object to be sealed by film-lid. Thereafter, the operation platform will be pushed to the outer side so that the object that has been sealed by film-lid may be removed and another object to be sealed by film-lid may be placed onto the cover 48. Repeatedly, the film-lid cohesion replacement motor will pull the operation platform to a point under a position under the cutting devices 37, 38. In addition, a sensor 49 may be set up by the cover 48 of the operation platform 42 to detect if the object to be sealed by film-lid has been placed onto such a cover. A sensor 18 may also be established between the film roller 17 and the film-lid cohesion transmission structure 3 to detect the rolling of the film so as to ensure that the primary film roller will be properly controlled.

Figure 9:
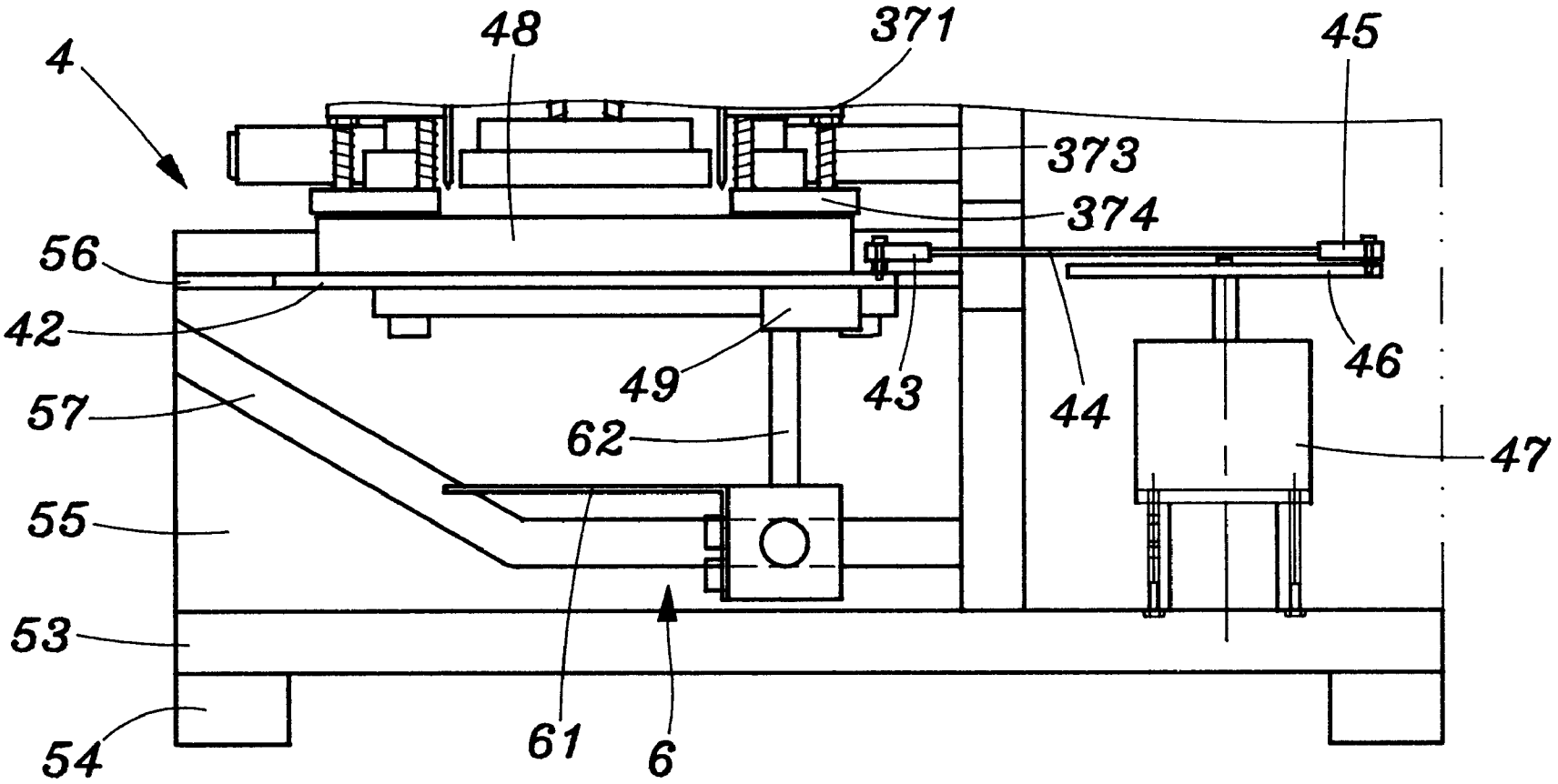
FIG. 9 is a side view of film-lid cohering object replacement device in this invention.
Figure 10:
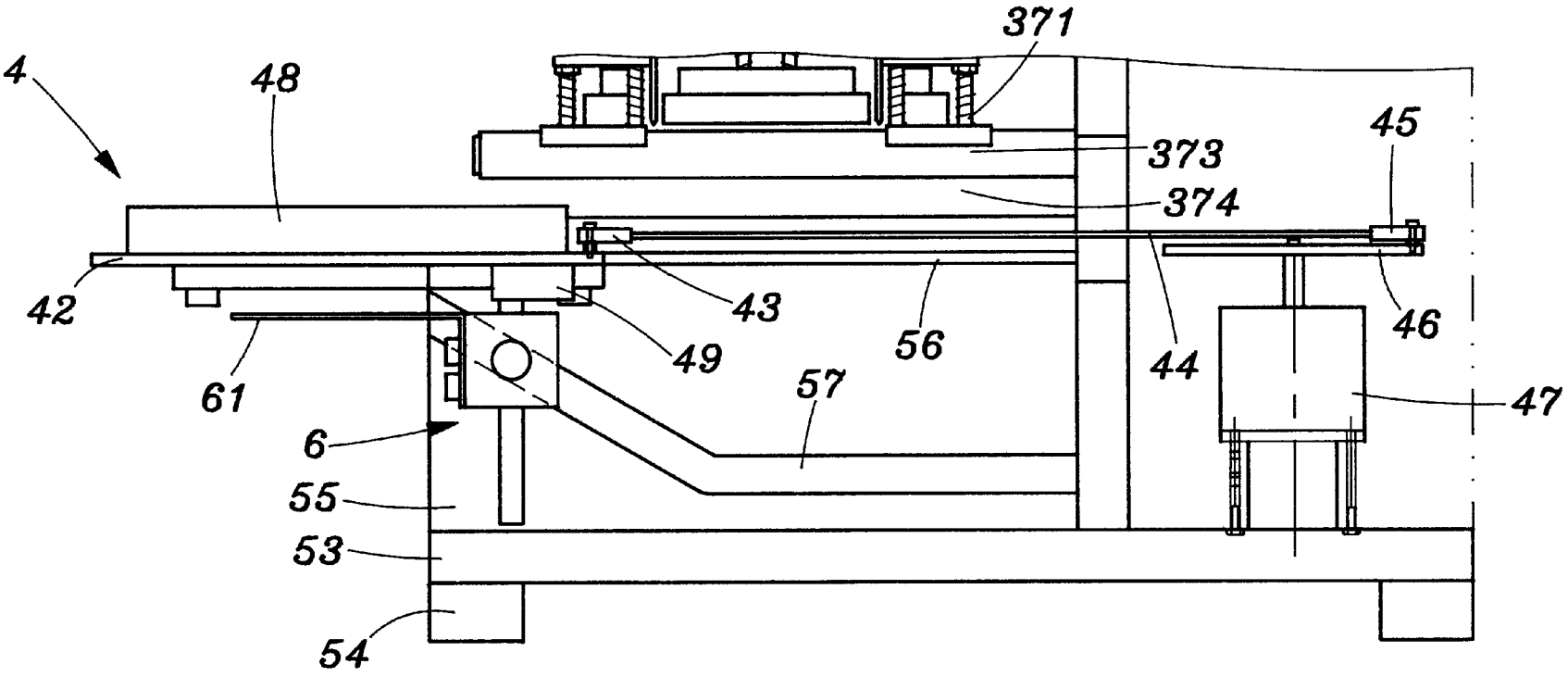
FIG. 10 is a scheme plan of the film-lid cohered replacement device in this invention.
Figure 11:
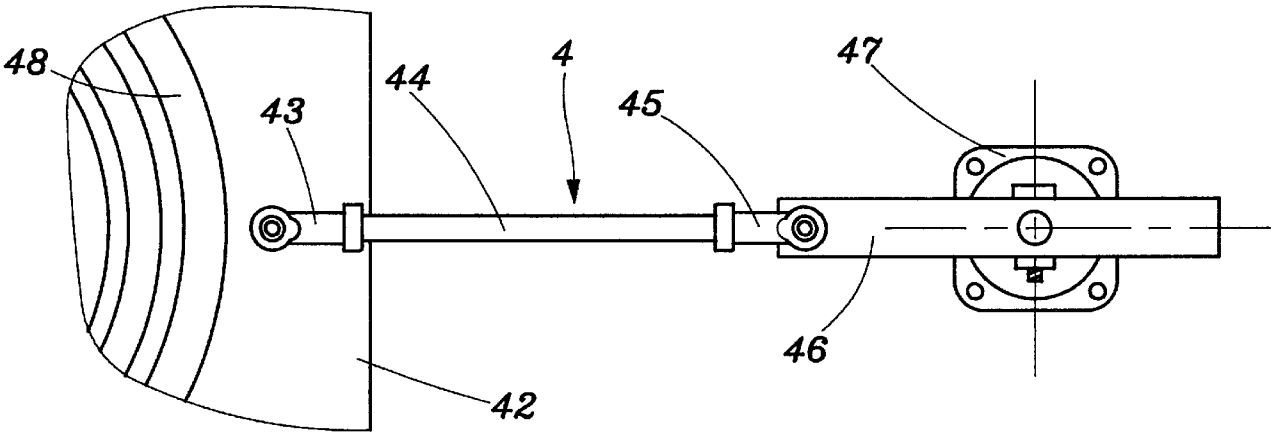
FIG. 11 is a scheme plan of the film-lid cohered replacement device in this invention.
Figure 12:
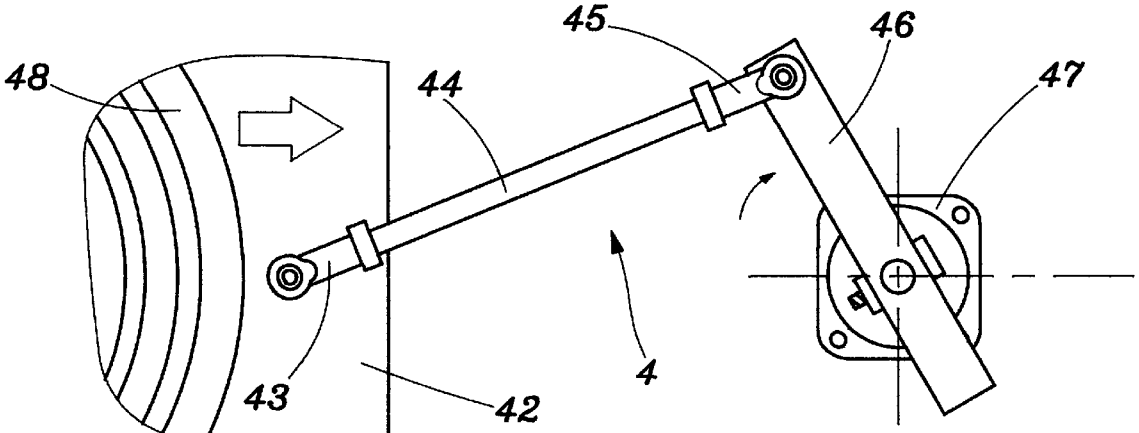
FIG. 12 is a scheme plan of the film-lid cohered replacement device in this invention.
Figure 13:
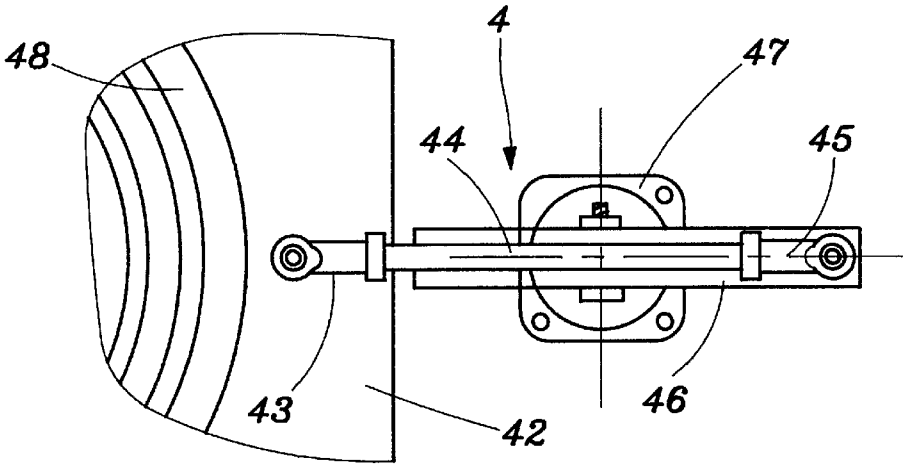
FIG. 13 is a scheme plan of the film-lid cohered replacement device in this invention.

An automatic propping device 6 is set up under the cover 48 of the film-lid cohesion object replacement device 4. (FIG. 9 and FIG. 10). Said automatic propping device contains a lift 61, and a lifting glide 57 is set up on the inner face of two grooved plates 55 of the holder 5. These two lifting glides 57 are ascending to the front. Both sides of the lift 61 fit and work in said two lifting glides 57. On the bottom of the operation platform 42 are two guide posts 62, the lift 61 works together with said guide posts 62. The lift may connect with the operation platform 42 so as to cause the lift 61 to move together with the operation platform 42. When the operation platform is pushed out, the lift 61 will be guided to elevate by the two lifting glides 57, whereby said lift will move upward to prop the film-lid cohesion object on the cover 48 and as such the cohered object may be removed.

The holder 5 includes a back plate 51. A partition plate 52 is set up at the center of the back plate, and a bottom plate 53 is set up at the bottom of the back plate. There are shock absorbing pads 54 at 4 corners of the bottom plate 53. On both sides of the bottom plate 53 are two grooved plates 55, in between are a glide groove 56 and a lifting glide 57. A plurality of guide posts 58 and rollers 59 are in front of the back plate 51 to guide the film to move forward.

These are the components for the present invention—"Automatic Film-lid Cohering Machine." Analysis and description on its integrated structure are further provided below.

When the Automatic Film-Lid Cohering Machine is turned on, the film-lid cohesion replacement motor 47 will be driven to cause the crank 46 to move the connecting bar 44, which will in turn push the operation platform 42 and place the object to be sealed by film-lid on the cover 48. In addition, said film-lid cohesion replacement motor 47 will be driven to pull the operation platform 42 to a position under the cutting devices 37, 38, whereby the motor 31 of the film-lid cohesion transmission structure 3 will be driven to cause the crank 32 and coupling bar 33 to lower the top connecting mold 35 and the cutting devices 37, 38, to contact the object to be sealed by film-lid. The external press plate 374 and internal press plate 384 will press fast the film, and the blades 375 will cut the film required for sealing. The heating plate 385 of the internal press plate 384 will cause the film to cohere to the object to be sealed by film-lid. Furthermore, the motor 31 will elevate the top connecting mold 35 together with the whole cutting devices 37, 38. At this moment, the feeding motor 15 will be driven to cause the primary film roller 16 and the film roller to roll the film 17 down. When a certain quantity of the film is given, the feeding motor will stop and the spring 21 of the anti-slide device 2 will prevent the film from rolling down. At the time when the film transmission structure 1 starts to process, the film-lid cohesion object replacement device 4 will process simultaneously. In other words, when the film-lid cohesion replacement motor 47 is driven, the crank will be caused to revolve. When the operation platform 42 is pushed out, the automatic propping device 6 will prop the object to be sealed by film-lid, whereby the object may then be removed. Next step is to place the bond sealer which has not been sealed with the film on the cover 48, and the bond sealer replacement motor 47 will be driven to pull the operation platform 42 to pull the cutting device to a position under the cutting devices 37 and 38. The sealing operations will be undertaken by following the foregoing process.

In consideration of all relevant description and explanations, this invention has the following advantages:

1. The significant simplification of the anti-slide device 2 of this invention results in a reduction of manufacturing cost because the manufacturing and assembly are made easier in this invention. Moreover, since it is no longer necessary to insert the film to the anti-slide device 2, the installation of the film has also become easier.
2. The design of the holder 5 is simplified, and as such the partition plate 52 and bottom plate may be established on the back plate 51. This design has simplified manufacturing and assembly process; accordingly, the manufacture cost will be reduced and the strength and stability will be improved.
3. The propping device 6 of this invention is to elevate the object to be sealed by film-lid onto the cover 48, so that the object may be promptly removed upon completion of the cohesion. In addition, the lift 61 is designed to work with two lifting glides 57 in the holder 5 so as to ensure a smooth forward and backward movement and elevation.
4. In this invention, the transmission of the primary film roller 16 is operated by the first gear 12 and the second gear 14. This is to prevent slacked transmission.

To sum up, this new utility invention is valuable in that it is designed to lower the manufacturing cost and to make operation easier. This invention is also innovative and advanced. An application for patent is therefore filed under the patent law. It is respectfully prayed that a discreet examination will be made and this application will be approved so as to protect the interests of the inventor.

I claim:

1. An automatic lid sealer, comprising:

a film transmission structure including a primary film roller, a film roller, and a feeding motor for driving said primary film roller thereby winding a film from said film roller;

an anti-slide device including a spring arranged at an end of said film roller for providing a biasing force toward said film roller;

a film-lid cohesion transmission structure including a motor disposed on a partition plate of a holder for driving a cutting device thereunder;

a bond sealer replacement device including an operation platform arranged within a pair of glide grooves of said holder and capable of moving forward and backward, a rear end of said operation platform being connected to a bond sealer replacement motor, a cover being arranged on said operation platform;

an automatic propping device for pushing said operation platform outward from said film-lid cohesion transmission structure, said device containing a lift disposed under said glide grooves of said holder for moving forward and backward while moving upward along a guide post disposed under said operation platform to prop an object from said operation platform, and wherein said holder includes a back plate, a partition plate established at a center of said back plate, and a bottom plate established at a bottom of said back plate, a pair of grooved plates being disposed at transverse sides thereof, a glide groove and a lifting groove being arranged on said grooved plate, said two lifting grooves being arranged in ascending manner.

2. The automatic film-lid cohering machine as recited in claim 1, wherein a shaft of said primary film roller includes a first gear and a clamp for fastening said primary film roller, said first gear engaging a second gear disposed on a shaft of said feeding motor, wherein when said feeding motor is moving, said first gear will be driven by said first gear to wind up said film onto said primary film roller.

3. The automatic film-lid cohering machine as recited in claim 1, wherein a front portion of said rear plate includes a plurality of guide posts and rollers for guiding said film.

* * * * *